US008141404B2

(12) United States Patent
Newport et al.

(10) Patent No.: US 8,141,404 B2
(45) Date of Patent: Mar. 27, 2012

(54) METHOD OF MANUFACTURING STRUCTURAL COMPONENTS FROM TUBE BLANKS OF VARIABLE WALL THICKNESS

(75) Inventors: Colin Newport, Ayr (CA); Stephen T. McSwiggan, Ingersoll (CA); Ovidiu I. Savescu, Cambridge (CA)

(73) Assignee: Arcelormittal Tubular Products Canada Inc., Hamilton (CA)

( * ) Notice: Subject to any disclaimer, the term of this patent is extended or adjusted under 35 U.S.C. 154(b) by 16 days.

(21) Appl. No.: 10/474,238

(22) PCT Filed: Apr. 4, 2002

(86) PCT No.: PCT/CA02/00464

§ 371 (c)(1),
(2), (4) Date: May 4, 2004

(87) PCT Pub. No.: WO02/081115

PCT Pub. Date: Oct. 17, 2002

(65) Prior Publication Data

US 2004/0200255 A1 Oct. 14, 2004

(30) Foreign Application Priority Data

Apr. 4, 2001 (CA) ..... 2342702

(51) Int. Cl.
*B21C 1/24* (2006.01)
*B21C 37/30* (2006.01)
*B21C 3/00* (2006.01)

(52) U.S. Cl. ..... 72/283; 72/276; 72/370.14

(58) Field of Classification Search ..... 72/370.22, 72/370.14, 370.15, 370.06, 370.07, 370.08, 72/58, 276, 283, 284
See application file for complete search history.

(56) References Cited

U.S. PATENT DOCUMENTS

| | | | | |
|---|---|---|---|---|
| 2,240,456 | A * | 4/1941 | Darner | 72/276 |
| 2,258,242 | A * | 10/1941 | Ditzel et. al. | 72/276 |
| 3,572,080 | A | 3/1971 | Alexoff et al. | |
| 3,754,428 | A | 8/1973 | Alexoff | |
| 3,789,650 | A | 2/1974 | Alexoff | |
| 4,616,500 | A * | 10/1986 | Alexoff | 72/283 |
| 4,726,211 | A * | 2/1988 | Sunaga et al. | 72/283 |
| 4,744,237 | A | 5/1988 | Cudini | |
| 4,759,111 | A | 7/1988 | Cudini | |
| 4,799,412 | A | 1/1989 | Alexoff | |
| 5,170,557 | A * | 12/1992 | Rigsby | 29/890.08 |
| 5,333,775 | A | 8/1994 | Bruggemann et al. | |
| 5,339,667 | A | 8/1994 | Shah et al. | |
| 5,557,961 | A | 9/1996 | Ni et al. | |
| 5,882,039 | A | 3/1999 | Beckman et al. | |
| 6,032,501 | A | 3/2000 | Bihrer | |
| 6,092,865 | A | 7/2000 | Jaekel et al. | |
| 6,122,948 | A | 9/2000 | Moses | |
| 6,183,013 | B1 * | 2/2001 | Mackenzie et al. | 280/797 |

FOREIGN PATENT DOCUMENTS

DE 3133804 5/1983

(Continued)

*Primary Examiner* — Debra Sullivan
(74) *Attorney, Agent, or Firm* — IpHorgan Ltd.

(57) ABSTRACT

A method for forming a tubular structural member includes the steps of cold forming a tube blank to have a longitudinally variable but circumferentially constant wall thickness (t1, t2, t3) and forming the blank into the desired structural member. Preferably, the forming step involves hydroforming.

8 Claims, 5 Drawing Sheets

FOREIGN PATENT DOCUMENTS

| | | | | |
|---|---|---|---|---|
| DE | 3133804 | C1 | * | 5/1983 |
| DE | 19751408 | A1 | | 6/1999 |
| EP | 0078551 | A2 | * | 11/1982 |
| EP | 0078551 | A2 | | 11/1982 |
| EP | 0760265 | A1 | | 3/1997 |
| EP | 1 177 843 | A2 | | 2/2002 |
| GB | 1259364 | | | 3/1961 |
| JP | 62224421 | A | * | 10/1987 |
| WO | WO 99/25506 | | | 5/1999 |
| WO | WO 01/88384 | A1 | | 11/2001 |
| WO | WO 02/11917 | A1 | | 2/2002 |

* cited by examiner

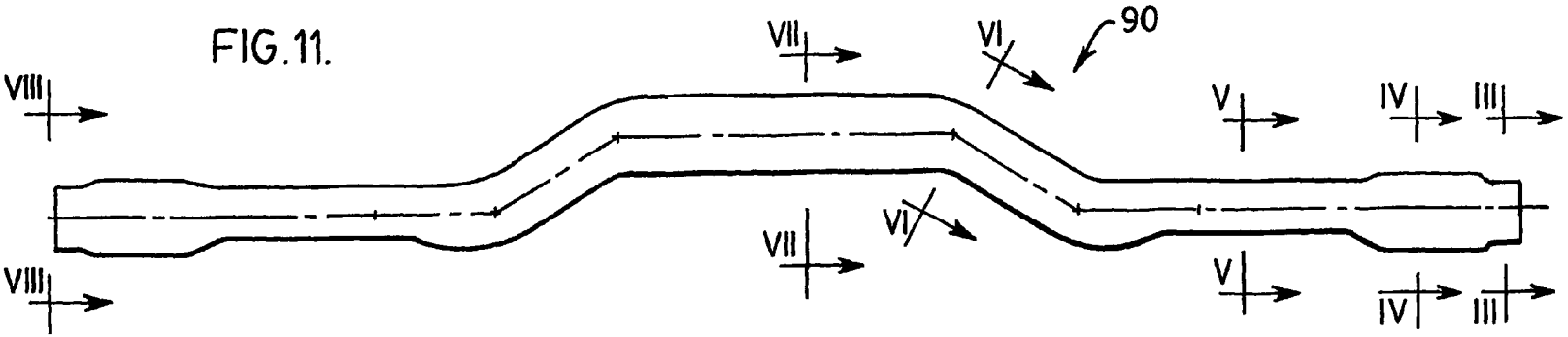
FIG.11.
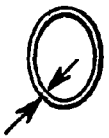
FIG.12A.
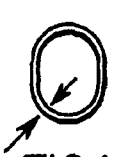
FIG.12B.
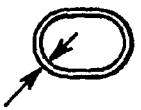
FIG.12C.
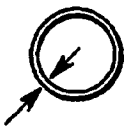
FIG.12D.
FIG.12E.
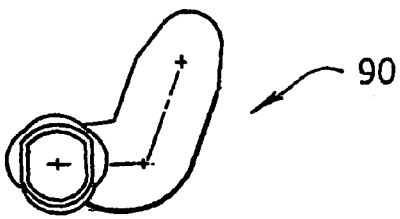
FIG.13.

METHOD OF MANUFACTURING STRUCTURAL COMPONENTS FROM TUBE BLANKS OF VARIABLE WALL THICKNESS

BACKGROUND OF THE INVENTION

1. Field of the Invention

The present invention relates to a method of forming tube blanks to achieve a desired shape. Specifically, the method involves the forming of tube blanks that have a variable wall thickness. More specifically, the forming process comprises hydroforming.

2. Description of the Prior Art

In the automotive industry, various structural components are made from tubular blanks. Such blanks are usually formed into the desired component shapes using various forming technologies. One of such techniques that has become popular is hydroforming. In hydroforming, a tubular blank is placed within a die having a shape of the desired component. The ends of the tube are sealed and a pressurized fluid is applied to the interior of the blank. Such pressure expands the blank until it conforms to the shape of the die cavity. In the usual case, prior to hydroforming, the tube blank is bent to the desired shape and the hydroforming step is used to provide the desired cross sectional shape. Generally, the wall thickness of the tubular blank is generally maintained throughout the forming process, although a slight degree of reduction may be realized due to the stretching of the tube.

In certain cases, it is desired that the finished product or component have a variable thickness in order to, inter alia, reduce the overall weight of the final product or to reduce the cost of the materials used to form the component. In other cases, the final product is required to have localized reinforcing in regions that are subjected to stresses, such as bends etc. or, in other cases, regions of weakness so as to preferably facilitate the bending of such sections. Various methods have been suggested to provide such variable wall product. For example, the method taught in U.S. Pat. No. 5,333,775 involves a number of tubular pieces of different wall thicknesses to be welded together to form the blank used in the hydroforming step. Although resulting in the required variable wall blank, and, therefore, formed product, this method includes various deficiencies. Firstly, the method involves the pre-forming step of creating the multiwall blank using a welding procedure, which adds a considerable amount to the total processing time. Secondly, the presence of welds may lead to weak spots in the formed product.

In U.S. Pat. No. 4,759,111, another method is taught where a first tube, of a constant wall thickness, is provided at certain locations with a co-axial sleeve thereby resulting in a tubular blank with a variable wall thickness. Such blank is then subjected to a hydroforming process as discussed above. Although no welding steps are performed, this method results in a non-homogenous product.

U.S. Pat. No. 5,557,961 teaches a method wherein the tubular blank is provided with a constant outer diameter, and which is used in a hydroforming process. The wall thickness of the blank taught in this reference varies circumferentially but is constant in the longitudinal direction. In other words, the blank is provided with longitudinal grooves along the interior surface. As a result, the component formed according the the '961 method includes thin sections, at any given cross section, wherein such thin sections extend along the length of the component. This reference does not, however, teach a formed component having a constant cross sectional or circumferential wall thickness.

The present invention provides an improved method for providing a formed product having a variable longitudinal wall thickness that overcomes at least some of the deficiencies discussed above.

SUMMARY OF THE INVENTION

In one aspect, the invention provides a method of making a generally tubular structural member having a variable wall thickness that is constant circumferentially but variable longitudinally, the method comprising the steps of:

1) producing a tube blank with a variable wall thickness;
2) placing said blank in a forming die and forming said member.

In another aspect, the invention provides a method of making a generally tubular structural member having a variable wall thickness that is constant circumferentially but variable longitudinally, the method comprising the steps of:

1) producing a tube blank with a variable wall thickness using a reciprocating mandrel and die assembly;
2) placing said blank in a forming die and forming said member to a desired cross sectional shape.

In yet another aspect, the invention provides a method of making a generally tubular structural member having a variable wall thickness that is constant circumferentially but variable longitudinally, the method comprising the steps of:

1) cold forming a tube blank with a variable wall thickness using a reciprocating mandrel and die assembly;
2) treating said blank to increase the formability thereof;
3) bending said blank at desired locations; and
4) placing said blank in a hydroforming die and applying internal pressure to said blank to hydroform said member to a desired cross sectional shape.

BRIEF DESCRIPTION OF THE DRAWINGS

These and other features of the preferred embodiments of the invention will become more apparent in the following detailed description in which reference is made to the appended drawings wherein:

FIG. 11 is a side view of the component of FIG. 9.

FIG. 12A is an end cross sectional view of the component of FIG. 11 along the plane III-III.

FIG. 12B is an end cross sectional view of the component of FIG. 11 along the plane IV-IV.

FIG. 12C is an end cross sectional view of the component of FIG. 11 along the plane V-V.

FIG. 12D is an end cross sectional view of the component of FIG. 11 along the plane VI-VI.

FIG. 12E is an end cross sectional view of the component of FIG. 11 along the plane VII-VII.

FIG. 13 is an end view of the component of FIG. 11 along the plane VIII-VIII.

DESCRIPTION OF THE PREFERRED EMBODIMENTS

Figure 1:
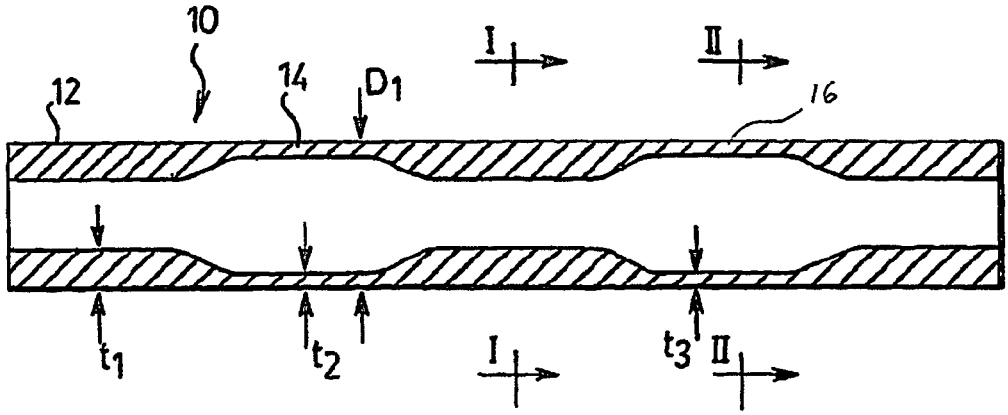
FIG. 1 is longitudinal cross sectional view of a tubular blank according to an embodiment of the invention.
Figure 2:
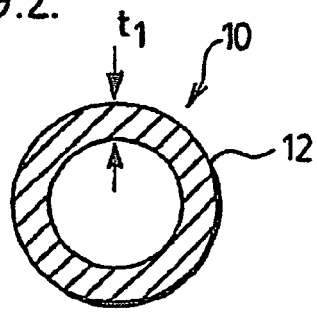
FIG. 2 is an end cross sectional view of the blank of FIG. 1 along the plane I-I.
Figure 3:
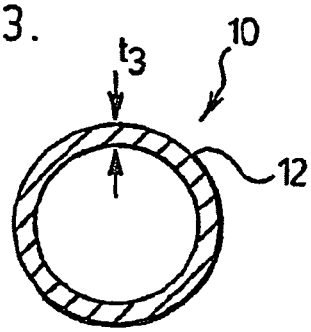
FIG. 3 is an end cross sectional view of the blank of FIG. 1 along the plane II-II.

FIG. 1 illustrates a tubular blank for use in the method of the present invention. As illustrated, the blank 10 comprises a tubular member having a generally uniform outer surface 12 and a generally uniform outer diameter D1. The blank 10 is formed with a variable wall thickness, as described further below, such that at desired portions, the wall thickness is reduced thereby resulting in a larger inner diameter. FIG. 1 illustrates two such reduced wall regions as 14 and 16. As indicated, the blank is originally provided with a wall thickness t1. At the first reduced thickness region, 14, the wall thickness is reduced to t2 and at the second reduced thickness region, 16, the wall thickness is reduced to t3. As will be appreciated, t2 and t3 may be the same or different depending upon the specific characteristics of the required blank. FIGS. 2 and 3 illustrate, respectively, the wall thicknesses of the blank at a non-reduced thickness region and a reduced thickness region. As can be seen, the wall thickness of each region is circumferentially uniform.

It will be understood by persons skilled in the art that although two reduced thickness regions are illustrated in FIGS. 1-3, the actual number of such regions will depend upon the specific requirements of the blank.

The reduced thickness regions discussed above can be formed by any means known in the art. An example of such process is provided in U.S. Pat. No. 4,616,500.

In a preferred embodiment, the blank is formed by passing a tube of constant wall thickness through a die and mandrel assembly. The mandrel is preferably of a reciprocating type that can be inserted and withdrawn from the die using a control apparatus. The die is co-axial with the tube and is provided in the interior thereof. As is known in the art, the tube is pulled through the die resulting in a constant outer diameter. During this process, the mandrel is inserted into the die cavity at specific times so as to reduce the wall thickness of the tube at desired locations along its length. In this manner, a tubular blank is formed having the desired regions of reduced wall thickness. In another embodiment, the formed tube obtained from the die and mandrel process may be cut to a desired length to result in the tube blank to be used in the method of the invention.

Figure 4:
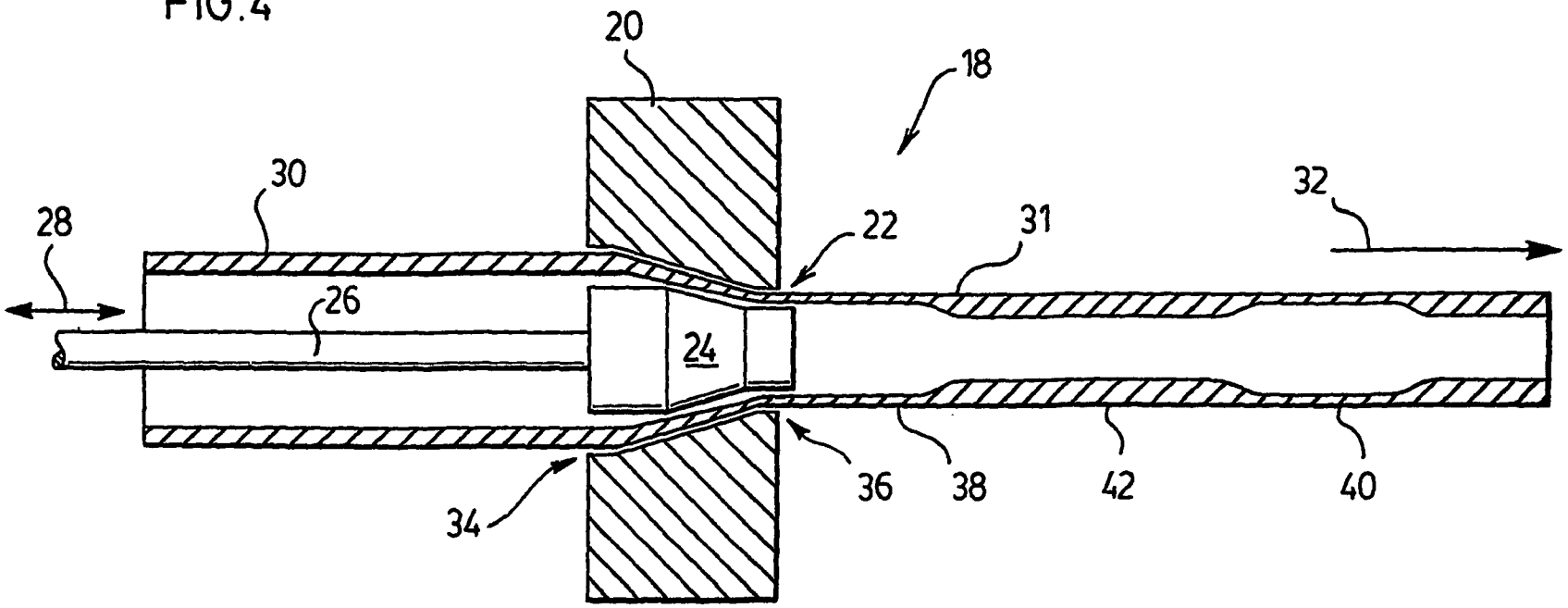
FIG. 4 is a cross sectional view of a die and mandrel apparatus for forming the blank of FIG. 1.

An example of a die and mandrel assembly that can be used in the present invention is illustrated in FIG. 4. As shown, the assembly 18 comprises a die 20 having a die cavity 22. A mandrel 24 is provided at one end of a rod 26. The rod 26 is attached, at its other end, to a control mechanism that allows the mandrel to be inserted and withdrawn from the die cavity 22 in a reciprocating manner as indicated by arrow 28. A tube 30 is attached at a first end to a draw machine, not shown, as is known in the art. The first end of the tube is then drawn through the die cavity so as to result in a drawn tube 31 having a constant outer diameter. The direction in which the tube is drawn is indicated by the arrow 32. The die cavity 22 is provided with a first opening 34 having a diameter to allow the passage of tube 30 and a second opening 36 having a diameter to allow the passage of tube 31. As can be seen, the diameter of opening 36 is less than that of opening 34. Accordingly, the diameter of the drawn tube 31 is generally less than that of the original tube 30.

As shown, the mandrel 24 is positioned within the interior of the tube 30 and is generally co-axial therewith. If the mandrel is moved into the die cavity 22, the wall of the tube 30 passing through the die cavity 22 is constricted. If the mandrel is removed from the die cavity, such constriction is not effected. Therefore, by reciprocating the mandrel 24 in and out of the die cavity 22 while the tube 30 is drawn there-through, the resulting drawn tube 31 may be provided with regions of thinned walls along the length thereof, while maintaining a constant outer diameter. As illustrated in FIG. 4, the drawn tube 31 includes thin wall regions 38 and 40, separated by a region where the wall thickness is not affected, 42. It will be understood by persons skilled in the art that the process of drawing the tube 30 through the die cavity 22 may impart a change in the wall thickness in the absence of any mandrel. However, where no mandrel is used, such change in wall thickness will be generally uniform thereby resulting in the drawn tube 31 having generally uniform inner and outer diameters. Further, as is known in the art, it is possible to form the blank with a number of different wall thicknesses by varying the mandrel used.

Once the drawn tube 31 described above is obtained, it may be cut to the desired length, if needed, thereby resulting in the tube blank 10 of the invention. In another embodiment, the desired length may be cut prior to inserting into the die and mandrel assembly, whereby the drawn tube 31 comprises the tube blank itself. In either case, the blank is then further processed, where necessary, and formed to the desired final shape as described further below.

Normally, prior to the final forming stage, the blank 10 is first bent in the desired two or three dimensional shape. In such manner, the final forming stage, such a hydroforming stage, is used to impart the desired cross sectional shape or shapes.

In the forming stage, the tube blank is delivered to a forming station. In the preferred embodiment, such forming station comprises a hydroforming station as is commonly known in the art. An example of a typical hydroforming apparatus is illustrated in FIG. 5.

Figure 6:
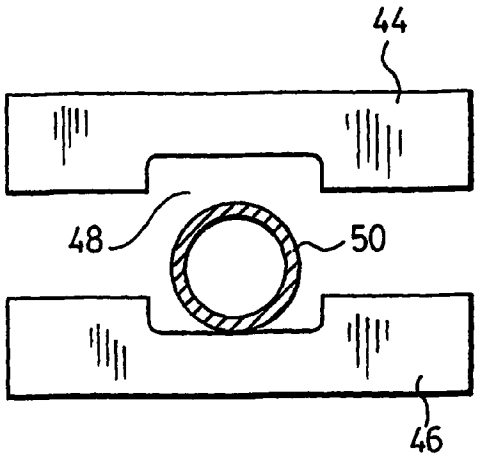
FIG. 6 is an end view of the die of FIG. 5 in an open position.
Figure 7:
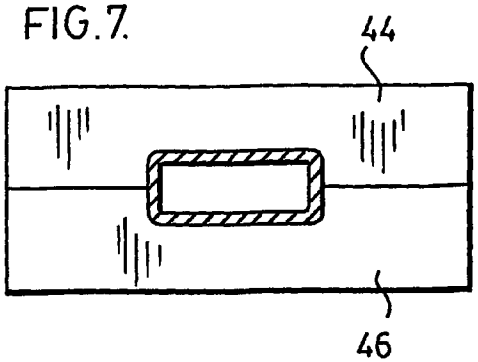
FIG. 7 is an end view of the die of FIG. 5 in an closed position.
Figure 5:
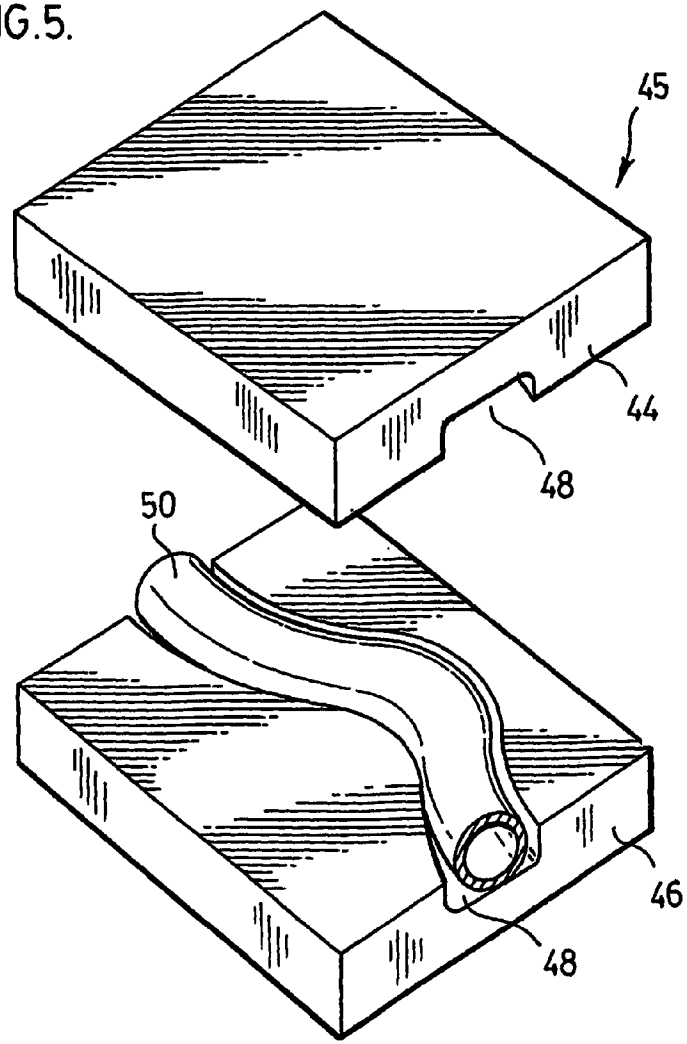
FIG. 5 is a perspective view of a hydroforming die according to one aspect of the invention.

As shown in FIG. 5, a hydroforming apparatus generally includes a die 45 having two sections 44 and 46. Each of sections 44 and 46 are provided with one half of a die cavity 48. The die cavity 48 is formed with the desired overall and cross sectional shape of the final component being made. As illustrated in FIG. 5, a tube blank 50 is placed within the die cavity when in the open position, as shown in FIGS. 5 and 6. As can be seen, the tube blank 50 is initially formed in the desired general shape of the desired element, including the required bends etc. Once in the die cavity 48, the sections 44 and 46 are closed, wherein both sections are in contact thereby forming and sealing the cavity 48. The ends of the blank 50 are then sealed and the interior of the blank 50 is pressurized until the blank assumes the cross sectional shape of the die cavity, as illustrated in FIG. 7. The above discussion has been provided in reference to a general tube blank 50. As will be appreciated, the present invention is directed to the forming of the specific tube blank 10 as illustrated in FIG. 1. It will be understood that the hydroforming apparatus illustrated in FIGS. 5 to 7 is simplified so as to illustrate the general principle. Various parts of the complete apparatus, such as seals, valves, control and pumping units etc., have been omitted for the purpose of clarity. However, such apparatus will be apparent to persons skilled in the art.

It will also be understood by persons skilled in the art that although the hydroforming process has been described, various other forming processes may also be used in method of the present invention.

As discussed above, prior to the hydroforming phase, the blank is first bent into the desired shape. In the preferred embodiment, prior to such bending, the blank is first subjected to a heat treatment, or stress relief process in order to impart the desired formability characteristics to the blank. Such a process prevents unwanted stress cracks and other damage to the blank during the bending process.

In the above discussion, reference has been made to a preferred embodiment wherein the tube blank is formed with a variable inside diameter but a constant outer diameter, as measured along the longitudinal axis. However, it will be understood that according to other embodiments, the method of the invention will be applicable to blanks having either a variable outer diameter or variable outer and inner diameters. The physical characteristics of the blank will depend upon the formed product that is desired.

In summary, the method of the invention includes, in one embodiment, the following steps:

1) a variable wall thickness tube blank is produced using the reciprocating mandrel and die assembly as discussed above;
2) the tube blank is treated (i.e. heat treated, annealed, stress relieved etc.) to restore the formability characteristics of the tube;
3) the tube blank is pre-bent and/or pre-formed;
4) the blank is placed in a die of a hydroforming tool or assembly;
5) the blank is expanded and formed as desired using the needed hydroforming parameters;

In the hydroforming process, the following steps are used:

a) the die, containing the bent blank, is closed;
b) the ends of the blank are sealed;
c) the tube is pressurized to the desired pressure (this pressure will depend on the wall thickness of the blank and the material from which it is formed);
d) the tube is expanded;
e) the pressure is released;
f) the die is opened and the formed component is removed.

As will be understood, the pre-bending or pre-forming steps mentioned above may not be needed for all components.

With the method of the present invention, various advantages are realized. For example, as indicated previously, by reducing the tube wall thickness in specific areas, the weight and cost of the final product is reduced. Further, the present invention provides a formed component that is homogenous with respect to material properties and one that avoids the need for numerous welded joints.

The method of the present invention can be used to make any tubular structural member. More specifically, the method of the invention is particularly suited for the manufacture of tubular components in the automotive industry. Such components include: axles; twist axles engine cradles; side rails (frame); transmission cross members; suspension components; and instrument panel cross members. As will be appreciated by persons skilled in the art, various other components, for use in any type of industry, may be manufactured by the method of the invention.

The following example is provided to illustrate the present invention and is not meant to be restrictive in any way of the scope thereof.

Example

Figure 8:
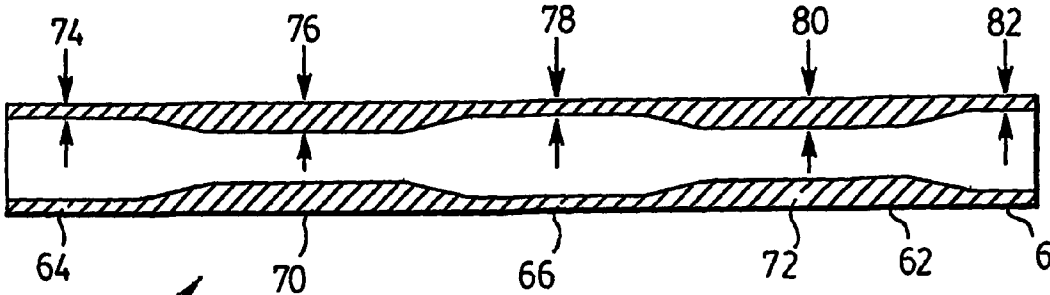
FIG. 8 is a side cross sectional view of a tube blank for forming an axle according to an embodiment of the invention.

An example of a component manufactured according to the method of the invention is illustrate in FIGS. 8 to 13, wherein a vehicle axle is formed. In FIG. 8, a tube blank 60 is illustrated. The blank 60 has an outer surface 62 with a generally uniform outer diameter. The blank 60 is provided with 3 regions of reduced inner diameter, 64, 66 and 68, respectively. Accordingly, the blank 60 is thus provided with two regions, 70 and 72, of a larger inner diameter. Due to the constant outer diameter, the difference in inner diameter leads to different wall thicknesses in the regions 64 to 72. In the preferred embodiment, such differences in wall thickness are achieved by the reciprocating mandrel and die assembly discussed above. In the example shown in FIG. 8, the various regions are formed with wall thicknesses 74, 76, 78, 80 and 82 in the following dimensions:

| Section | Wall Thickness |
|---|---|
| 74 | 3 mm |
| 76 | 5 mm |
| 78 | 3.4 mm |
| 80 | 5 mm |
| 82 | 3 mm |

In the example of FIG. 8, the initial tube, prior to the die forming step had a generally constant wall thickness of 5 mm and a length of approximately 1.77 m.

Figure 9:
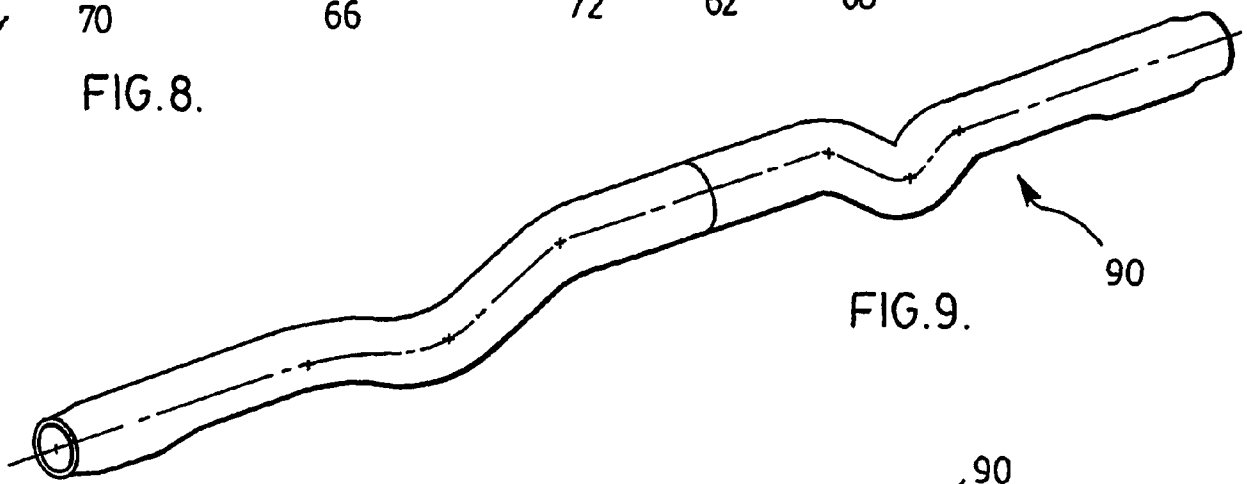
FIG. 9 is a perspective view of the component formed from the blank of FIG. 8.
Figure 10:
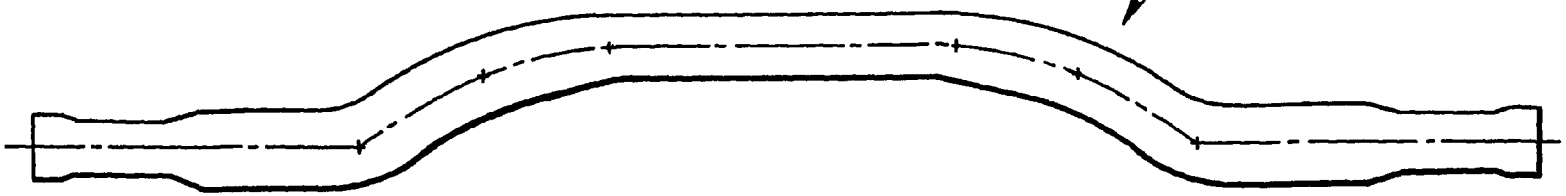
FIG. 10 is a side view of the component of FIG. 9.

FIGS. 9, 10 and 11 illustrate the axle 90 formed using the blank 60 of FIG. 8. As shown, the axle 90 includes a number of bends, which were formed by bending the blank 60. After the bending process, the blank was then hydroformed in a conventional manner to provide the desired cross sectional shapes. Such shapes are illustrated in FIGS. 12 and 13. The cross sections shown in FIG. 12A-E have the following wall thicknesses:

| Figure | Wall Thickness |
|---|---|
| 12 A | 3 mm |
| 12 B | 3 mm |
| 12 C | 5 mm |
| 12 D | 5 mm |
| 12 E | 3.4 mm |

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A method of making a generally tubular structural member having a variable wall thickness that is constant circumferentially but variable longitudinally, the method comprising the steps of:

providing a tube having initial outer and inner diameters and an initial wall thickness;

providing a stationary die having a die cavity for receiving said tube, said die cavity having a die first diameter and a die second diameter, said die second diameter being larger than the die first diameter, and a tapered portion extending between said die first diameter and die second diameter;

providing a mandrel, said mandrel being adapted to be inserted into said tube and having a first end connected to a support rod and an opposite second end, said mandrel first end having a mandrel first diameter and said mandrel second end having a mandrel second diameter, the mandrel second diameter being less than the mandrel first diameter, wherein the mandrel includes a tapered portion extending between said first and second ends, and wherein said die first diameter is less than the mandrel first diameter but larger than the mandrel second diameter;

inserting said tube through said die cavity and causing said tube and die to move with respect to each other along the longitudinal axis of said tube, wherein said tube is drawn through the die cavity while maintaining said die stationary;

inserting said mandrel within said tube; and reciprocating the mandrel in and out of the die cavity while said tube is drawn through said die cavity whereby the tube wall thickness is reduced as the mandrel first end is advanced towards said die first diameter;

the tube wall thickness being reduced from the initial wall thickness by an amount that increases as the mandrel first end is moved towards said die first diameter and decreases as the mandrel first end is moved away from said die first diameter to enable variable reductions in the tube wall thickness while said tube is drawn through said die cavity;

wherein movement of the mandrel is effected by a control mechanism operably attached to the mandrel and movement of the tube is effected by a drawing machine operably attached to the tube, and wherein movement of the mandrel is independent of the movement of the tube and wherein said die is maintained stationary during the reciprocal movement of said mandrel;

wherein the tube is provided with at least two longitudinally extending regions of constant reduced wall thickness at desired locations along its length, each of said at least two longitudinally extending regions of constant reduced wall thickness comprising a different reduced wall thickness; and wherein each longitudinally extending region of constant reduced wall thickness is adjacent to at least one tapered region of varying wall thickness.

2. The method of claim 1 wherein said die cavity second diameter is smaller than the initial outer diameter of said tube whereby relative movement of said die and tube results in a reduction in the initial outer diameter of said tube.

3. The method of claim 2 wherein said mandrel first end is advanced towards said die first diameter when said die overlaps a section of said tube where wall thickness reduction is desired.

4. The method of claim 3 wherein said method is conducted under cold forming conditions.

5. The method of claim 4 further including a treatment step wherein said tube is treated to increase the formability thereof.

6. The method of claim 5 wherein said treatment comprises annealing or heat treating.

7. The method of claim 5 further including a bending step, following the treatment step, wherein the tube is bent at desired locations.

8. The method of claim 5 further comprising forming said tube into a desired three dimensional shape.

* * * * *